US005894114A

United States Patent [19]

Eigenmann

[11] Patent Number: 5,894,114

[45] Date of Patent: Apr. 13, 1999

[54] SOUND ABSORBER FOR BLOWER

[75] Inventor: Joerg Eigenmann, Karlsruhe, Germany

[73] Assignee: Robert Bosch GmbH, Stuttgart, Germany

[21] Appl. No.: 08/907,214

[22] Filed: Aug. 6, 1997

[30] Foreign Application Priority Data

Aug. 6, 1996 [DE] Germany ..... 196 31 664

[51] Int. Cl.[6] ..... E04F 17/04

[52] U.S. Cl. ..... 181/224; 181/225

[58] Field of Search ..... 181/224, 225, 181/228, 230, 231, 229, 258, 267, 279, 280

[56] References Cited

U.S. PATENT DOCUMENTS 2,731,194 1/1956 Kent ..... 181/225

4,751,980 6/1988 De Vane ..... 181/224

4,872,528 10/1989 Goplen et al. ..... 181/228

5,266,753 11/1993 Muschelknautz et al. ..... 181/224

FOREIGN PATENT DOCUMENTS 42 05 489 A1 3/1993 Germany .

*Primary Examiner*—Khanh Dang

*Attorney, Agent, or Firm*—Michael J. Striker

[57] ABSTRACT

A sound absorber for a blower has a housing having an air inlet opening, an axially arranged air outlet passage, and a substantially spiral-shaped passage which connects the air inlet opening with the air outlet passage, a sound absorption material which forms walls of the substantially spiral-shaped passage, and reflector which at least partially surrounds the air outlet passage and screens the air outlet passage in direction of an air inlet opening.

15 Claims, 2 Drawing Sheets

SOUND ABSORBER FOR BLOWER

BACKGROUND OF THE INVENTION

The present invention relates a sound absorber for blowers.

In blowers there is an especially extensive noise generation, when high flow speeds and a great pressure increase is produced at high rotary speeds. It can be reduced by sound absorbers, which are arranged in the aspiration region.

In stroke piston internal combustion engines carbon monoxide and hydrocarbon compounds are produced in the exhaust gas during a cold start because of the incomplete combustion resulting from the mixture expansion. If fresh air is blown into an exhaust system of a stroke piston internal combustion engine, an exothermic post-oxidation of the hydrocarbon compounds is produced. The contents of the carbon monoxide and hydrocarbon compounds is thereby directly reduced. Additional heat is supplied to the catalysts by the combustion process, which is advantageous for the cold start. The catalysts reaches fast a favorable operational temperature.

During blowing of fresh air into the exhaust system secondary blowers are utilized. The fresh air can be aspirated through an air filter of the stroke piston internal combustion engine. Additional conduits are provided for this purpose and involve substantial expenses. If the fresh air is aspirated from the free atmosphere, for example through a not closed opening, the noise generation from the blower which is produced for the above mentioned reasons must be absorbed or dampened. For this purpose separate sound absorbers are used for the blower.

Such a blower is disclosed for example in the German patent document DE A1 4205489 and shown in this reference in FIGS. 5 and 6. The sound absorber has a housing cup with a flat cup bottom, a cup wall and a housing cover which closes the cup opening. An air inlet opening is formed by a bore hole in the cup wall, and an air outlet passage is formed by a central bore hole. The air inlet opening and the air outlet passage are connected by a spiral passage. The passage is formed by a damping insert of an open-pore, sound absorbing material. The passage from the cup bottom to the housing cover extends in an axial direction of the blower. The passage is limited by the cup bottom and the housing cover.

The noise generation, especially an aspiration noise produced in the region of the aspiration opening of the blower and thereby at the air outlet passage of the sound absorber is not sufficiently dampened.

SUMMARY OF THE INVENTION

Accordingly, it is an object of the present invention to provide a sound absorber for blowers, which avoids the disadvantages of the prior art.

In keeping with these objects and with others which will become apparent hereinafter, one feature of the present invention resides, briefly stated, in a sound absorber for a blower, in which a reflector partially surrounds an air outlet passage and screens the same in direction of the air inlet opening.

When the sound absorber for a blower is designed in accordance with the present invention, the reflector which is mounted on the air outlet passage of the sound absorber extends in an axial direction of the sound absorber and opens only toward the direction in which the passage opens into the air outlet passage, and screens the region of the air outlet opening of the sound absorber. Therefore, sound waves are reflected from the region of the suction opening of the sound absorber and dampened by the sound absorption material. A sound wave propagation outwardly, in particular through the air inlet opening, is prevented. This leads to a special efficiency increase of the sound absorber, since without the reflector the direction of the air inlet opening is small and thereby the sound waves in this region can easily propagate outwardly.

The sound absorption is advantageously enhanced when the reflector follows the contour of the air outlet passage and the passage, so that a sound wave propagation in a maximum great region is prevented or reduced by the reflector. Since the reflector is closed as much as possible, plural multiple reflections of the sound waves occur inside the reflector and they can propagate outwardly in a weakened form or do not propagate at all.

The sound resistance in direction of the air inlet opening and thereby the action of the sound absorber is increased when the sound absorption material is condensed in direction of the air inlet opening. Furthermore, the sound resistance increases from the air outlet passage in direction to the open side of the reflector by the condensed sound absorption material. In advantageous manner, the reflector can follow the passage in a spiral-shaped way.

The damping action of the reflector is improved when it is completely surrounded by the sound absorption material. When sound waves are radiated in direction of the reflector, they must pass through the sound absorption material before the reflector at least twice, one time prior to the reflection and one time after the reflection, before they can pass outwardly through the outer layer of the absorption material. This substantially dampens the sound waves.

When the housing of the sound absorber and the reflector are formed of one piece with one another, no additional components are needed. Therefore, a simple mounting, and a light and cost-favorable construction is provided. Since the reflector does not contact the blower, the blower does not transmit any body sound to it. Thereby, also no sound is transmitted through the reflector and the housing of the sound absorber to the environment.

When the reflector is formed as a separate component which is mounted in the housing of the sound absorber and is in contact with it without other components in addition to the absorption material, the mounting is slightly more expensive. However, the reflector is not excited to perform vibrations by the body sound transmission and does not excite any other components. The sound absorption is improved. In addition, the housing of the sound absorber can be produced in a cost-favorable manner since the molding-on of the reflector is dispensed with.

Because of the deviation in the approximately spiral-shaped passage, the sound resistance through the passage is increased. The reason is that the passage is longer and the sound waves are partially absorbed at each deviation.

The sound absorber and the blower can have a joint partition, for example when the sound absorber is open in direction toward the blower. In this case, the sound absorption material is located directly on the blower and thereby reduces the sound emission of the blower. Further, an intermediate wall is dispensed with. The sound absorber is axially shorter and the construction is in general lighter and more cost-favorable.

The housing of the sound absorber can completely cover a side of the blower, for example the periphery of the housing can be at least as great as of the blower. Therefore, a direct emission of the sound waves from the blower is suppressed. In addition, due to the great periphery of the sound absorber, a longer passage is possible, which positively influences the sound damping since the sound waves before displacing outwardly through the passage must cover a longer path.

The housing of the sound absorber can be provided on its periphery with a cylindrical fitting surface and the blower can be provided with a corresponding counter surface. Thereby the both parts are connected with one another and relative movements between the parts with a resulting additional noise generation is avoided. In addition, open locations through which the sound can easily propagate outwardly can be reduced.

A sound propagation from the passage through the housing of the sound absorber and the sound propagation along the passage are reduced by forming the sound absorption material of at least two layers. One layer contains the passage while the other layer separates the passage from the housing of the sound absorber.

Three layers can be provided as well, so that the passage is additionally separated from a further component, for example the blower itself. The sound propagation along the passage is additionally reduced by this feature. The sound emission of further parts, for example of the blower itself, is prevented.

When in the housing of the sound absorber three layers of the sound absorption material are provided and the reflector is formed as a separate component located in the housing, it is preferably arranged in the central layer. Also, it is separated by the two outer layers from the housing of the sound absorber and the blower.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
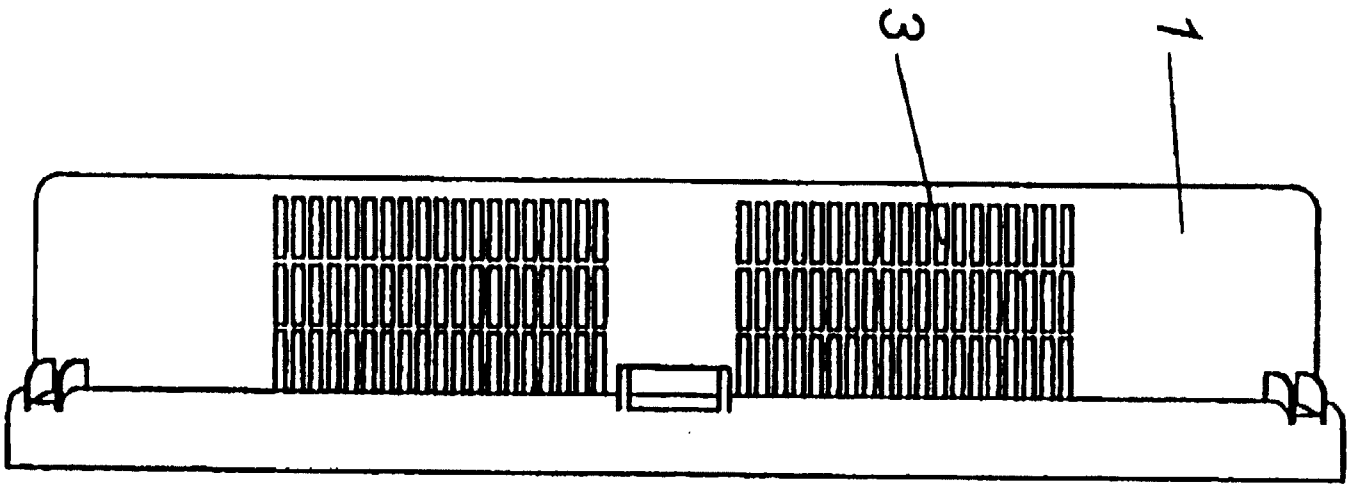
FIG. 1 is a side view of a sound absorber without a separating wall, in accordance with the present invention.
Figure 2:
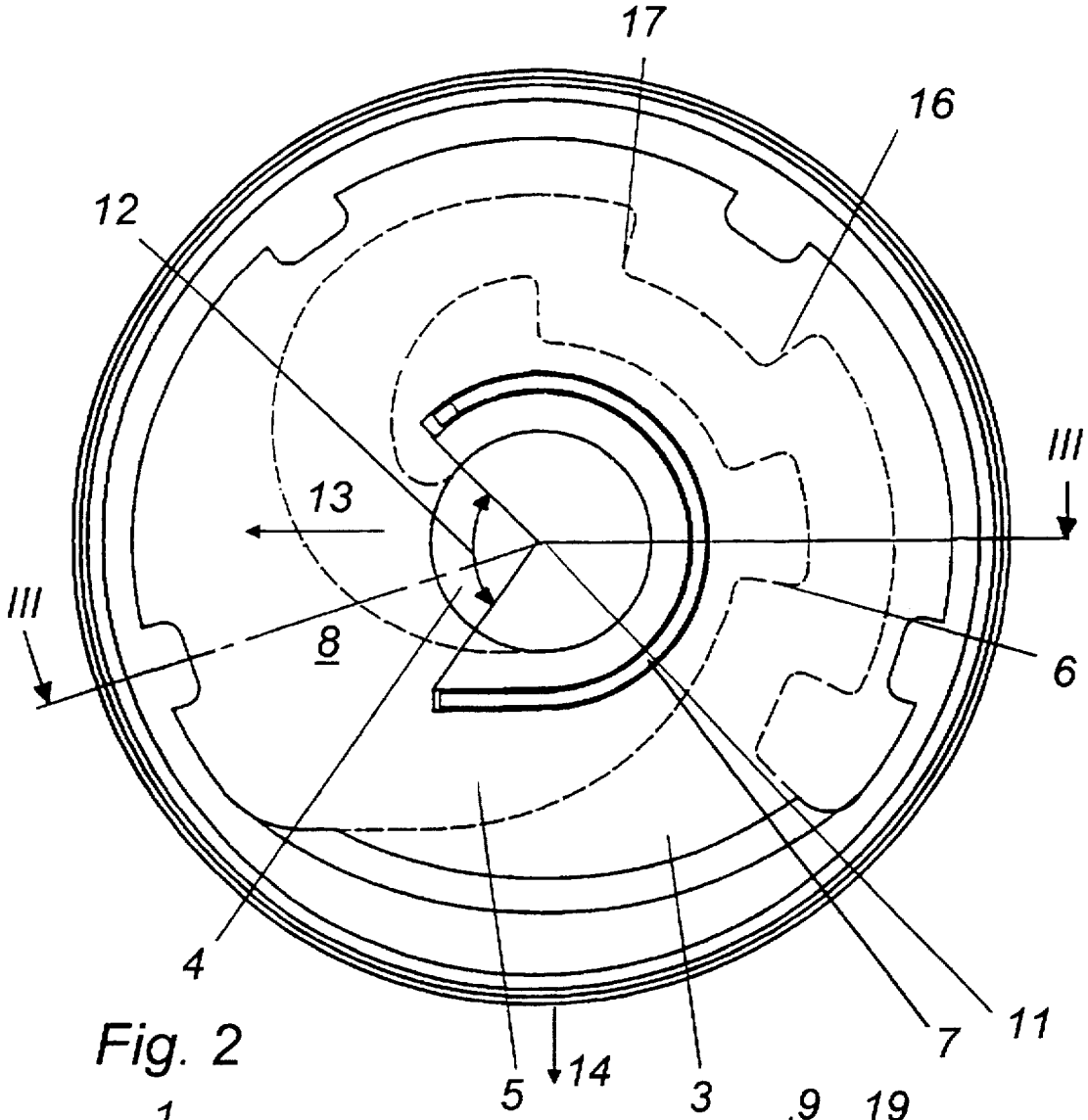
FIG. 2 is a front view of the sound absorber without the separation wall.
Figure 3:
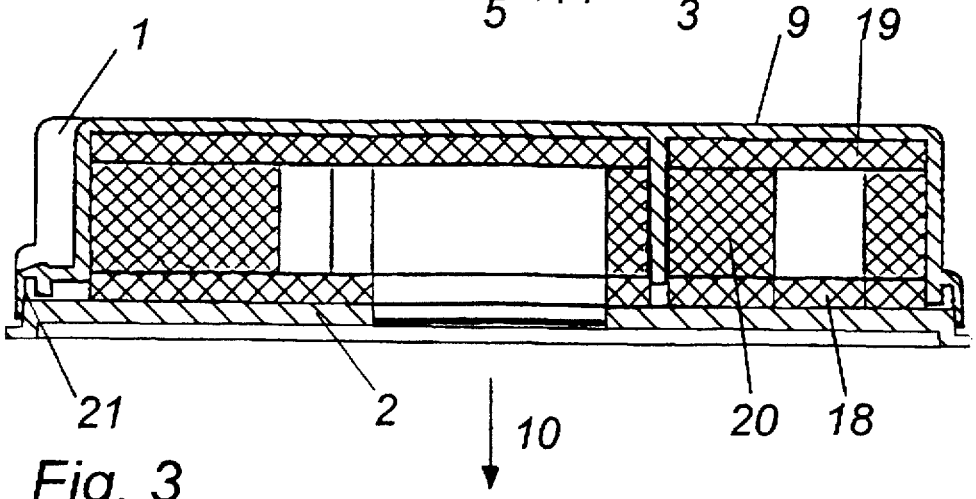
FIG. 3 is a view showing a longitudinal section taken along the line 3 in FIG. 2.

A sound absorber in accordance with the present invention is shown in FIG. 1 from one side. The sound absorber includes a housing 1 provided with an air inlet opening 3 and an air outlet passage 4. The air outlet passage 4 is arranged centrally or eccentrically and axially and connected with a suction opening of the blower. A grate can be located before the air inlet opening 3 for air filtering. The air inlet opening 3 is arranged generally radially. However, it can be also arranged axially when it is desirable from the reasons of space economy.

The air inlet opening 3 has a great cross-section. Thereby in this region the flow speed is low and therefore no tonal exitation by flowing around of the grate is generated. The noise formation in this region does not occur. Further, the greater air inlet opening 3 can not be clogged with dirt easily when compared with a small air inlet opening. This is important when the air inlet opening 3 is positioned under the vehicle.

The housing 1 and the blower have a joint partition 2. The partition is formed for example since the housing 1 has no housing wall in direction 10 of the blower. Preferably, the housing 1 of the sound absorber covers a side of the blower completely. It is either fixedly arranged on the housing of the blower by mounting, or is integrated in the housing of the blower.

The air inlet opening 3 and the air outlet passage 4 are connected with one another by an approximately spiral-shaped passage 6. The fresh air is aspirated through by the passage 6 and through the sound absorption material. The walls of the passage 6 are formed by the sound absorption material 5. The sound absorption material 5 has for example an open-pore surface with a low flow resistance. The sound absorption material 5 is arranged in the housing 1 in two, three or more layers 18, 19, 20. The passage 6 in the case of more than two layers 19, 20 is always screened from outside by the layers 18, 19. In other words, it is located then always in one of the central layers 20.

The housing 1 is open in direction 10 of the blower, so that a layer 18 directly abuts against the housing. It prevents the sound emission of the blower.

The passage 6 has several deviations 15, 16, 17. The deviations provide an increased sound resistance through the channel 6. The channel 6 is lengthened and the sound waves are absorbed at the deviations 15, 16, 17.

A reflector 7 is arranged around the air outlet passage 7. It follows the contour of the air outlet passage 4 which is for example round and of the passage 6. Therefore, the opening angle 12 when measured from the center point 11 of the air outlet passage 4, is smaller than 180°. The open side 8 of the reflector 7 is oriented not in direction of the air inlet opening 3.

The reflector 7 can be formed as a separate component or can be molded on the housing wall 9 of the sound absorber. The reflector 7 is completely surrounded with the sound absorption material 5. When the reflector 7 is formed on the housing 1, it has only the direct contact with the sound absorption material 5 and the housing 1, but not with the blower. It is screened from the blower either by an air gap or by a layer of sound absorption material 5.

The reflector 7 can be formed as a separate component and arranged in the housing 1. In this case, it is screened completely for example by two layers of the sound absorption material 5 from the housing 1 and from the blower.

The sound absorption material 5 is condensed in direction of the air inlet opening 3 and the direction 13, facing away from the open side 8 of the reflector 7. Thereby an increased sound absorption in these directions 13, 14 is achieved.

It will be understood that each of the elements described above, or two or more together, may also find a useful application in other types of constructions differing from the types described above.

While the invention has been illustrated and described as embodied in sound absorber for blower, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

1. A sound absorber for a blower, comprising a housing having an air inlet opening and an axially arranged air outlet passage, and a substantially spiral-shaped passage which connects said air inlet opening with said air outlet passage; a sound absorption material which forms walls of said substantially spiral-shaped passage; and a reflector which at least partially surrounds said air outlet passage and screens said air outlet passage from said air inlet opening.

2. A sound absorber as defined in claim 1, wherein said reflector follows a contour of said air outlet passage and said substantially spiral-shaped passage, so that an opening angle as measured from a center point of said air outlet passage is smaller than 180°.

3. A sound absorber as defined in claim 1, wherein said sound absorption material is condensed in direction of said air inlet opening.

4. A sound absorber as defined in claim 1, wherein said absorption material is condensed in direction toward an open side of said reflector.

5. A sound absorber as defined in claim 1, wherein said reflector is completely composed of said sound absorption material.

6. A sound absorber as defined in claim 1, wherein said housing and said reflector are formed as a one-piece integral member.

7. A sound absorber as defined in claim 1, wherein said reflector is formed as a separate component which contacts exclusively with said sound absorption material.

8. A sound absorber as defined in claim 1, wherein said substantially spiral-shaped passage has at least one deviation.

9. A sound absorber as defined in claim 1, wherein said housing has a joint partition with the blower.

10. A sound absorber as defined in claim 1, wherein said housing is formed so that it completely covers a side of the blower.

11. A sound absorber as defined in claim 1, wherein said housing has a periphery provided with a cylindrical fitting surface corresponding to a counter surface of the blower.

12. A sound absorber as defined in claim 1, wherein said substantially spiral-shaped passage is separated from said housing.

13. A sound absorber as defined in claim 1, wherein said sound absorption material has at least two layers, one of said layers containing said substantially spiral-shaped passage while another of said layers is located between said substantially spiral-shaped passage and a wall of said housing.

14. A sound absorber as defined in claim 1, wherein said sound absorption material includes at least three layers, one of said layers being located between said substantially spiral-shaped passage and an adjoining component of the sound absorber.

15. A sound absorber as defined in claim 13, wherein said sound absorption material includes at least three layers, one of said layers being located between said substantially spiral-shaped passage and a second wall of said housing.

* * * * *